US006714767B2

(12) United States Patent
Fan

(10) Patent No.: US 6,714,767 B2
(45) Date of Patent: Mar. 30, 2004

(54) MOBILE TELEPHONE BACK-CLAMPING DEVICE

(76) Inventor: Eagle Fan, 30, Luchang, Luchang Li, Chupei City, Hsinchu (TW), 302

( * ) Notice: Subject to any disclaimer, the term of this patent is extended or adjusted under 35 U.S.C. 154(b) by 545 days.

(21) Appl. No.: 09/749,780

(22) Filed: Dec. 28, 2000

(65) Prior Publication Data

US 2002/0132592 A1 Sep. 19, 2002

(51) Int. Cl.[7] ..... H04B 1/38; H04N 1/00

(52) U.S. Cl. ..... 455/90.3; 455/575.1; 455/575.8

(58) Field of Search ..... 379/446, 454, 379/455; 455/575.1, 575.8, 90.3, 347, 344; 224/271, 669, 272, 197, 930, 597

(56) References Cited

U.S. PATENT DOCUMENTS

| | | | | |
|---|---|---|---|---|
| 5,678,281 A | * | 10/1997 | Kamp et al. | 24/3.11 |
| 5,730,342 A | * | 3/1998 | Tien | 224/271 |
| 5,850,996 A | * | 12/1998 | Liang | 248/221.11 |
| 6,283,348 B1 | * | 9/2001 | Wang | 224/271 |
| 6,286,737 B1 | * | 9/2001 | Whitley | 224/271 |
| 6,315,255 B1 | * | 11/2001 | Chan et al. | 248/221.11 |

* cited by examiner

*Primary Examiner*—Vivian Chin
*Assistant Examiner*—Yuwen Pan
(74) *Attorney, Agent, or Firm*—Rabin & Berdo, P.C.

(57) ABSTRACT

The invention is a kind of improved mobile telephone back-clamping device consisting of a telephone rack, a fixture, a pushing block, a back-clamping plate and a clamp-on plate. Two pushing rods are extended out from the front end of the pushing block to form an inclined pressed part. Also, a pushing part is formed on the outer side of each pushing rod so that the complete front end of the pushing block can be into a rectangular transparent trough at the center of the telephone rack. By means of their barbed structure, each of the pushing parts can push against the rectangular transparent trough. A clasping block is located on each side at the front end of the telephone rack and an extended part is extended out from the rectangular transparent trough's base plate. The extended part has a barb at the front end and an inclined block on each side. One end of the fixture is opened to cover the front end of the telephone rack. A partition board having an outlet is equipped inside the fixture. When the fixture is combined with the telephone rack, the partition board will be right next to the top of the two inclined blocks on the telephone rack and will allow the barb stretch out through the top of the outlet. By the combination structure of pivot, axle hole and latch, the back-clamping plate can be combined onto the back of the telephone rack.

5 Claims, 6 Drawing Sheets

MOBILE TELEPHONE BACK-CLAMPING DEVICE

FIELD OF THE INVENTION

The present invention relates to a kind of improved mobile telephone back-clamping device, and more particularly, which comprises a telephone rack, a fixture, a pushing block, a back-clamping plate and a clamp-on plate.

BACKGROUND OF THE INVENTION

A conventional mobile telephone back clamping structure generally comprises a telephone rack, a spring, a clamping device, a pocket and a pushing block. The pushing block pushes against a sliding block to make vertical movement and the sliding block pushes against a shifting block that connects with the mobile telephone to mount or dismount the mobile telephone onto or from the shifting block. Due to the fact, such a mobile telephone back-clamping assembly has very complicated subassemblies and is difficult to operate as well as inconvenient to use. The inventor of the present invention has designed an improved mobile telephone back-clamping structure in accordance with the conventional mobile telephone back-clamping assemblies. A patent application directed to an improved mobile telephone back-clamping structure has been lodged.

The present invention's structural design mainly comprised a telephone rack, a fixture, a press block, a spring and a pushing block. The telephone rack comprised two symmetrical units where the pushing block having a pressed part at the end was placed inside the pocket of the telephone rack. The pressed part was attached firmly to the sides of the press block before being placed together into the pocket. The fixture was to be fixed on the front end of the telephone rack. The pushing block and the spring were clamping units molded directly and in advance in a preinstalled mold of the telephone rack. The fixture and the press block were also structures formed in one mold. The press block was directly formed at the center of the inner rim with a inclined block on each side. The clasps on both sides of the inner rim were clipped onto the lock holes at the ends of the telephone rack to form a complete back-clamping structure. Notwithstanding the structure was designed to be practical, the inventor has made further improvements to make the structure simpler, the operation easier and the number of components fewer. easier and the number of components fewer.

SUMMARY OF THE INVENTION

The invention mainly aims to provide a kind of improved mobile telephone back clamping device, which is easy to use and has practical structural design.

Another purpose is to provide a kind of simple-structured mobile telephone back clamping structure, which can achieve telephone clasping and releasing functions without any spring element in operating.

In order to achieve the foregoing purposes, the improved mobile telephone back clamping device is equipped with a telephone rack, a fixture, a pushing block, a back-clamping plate and a clamp-on plate. Two pushing rods are extended out from the front end of the pushing block to form an inclined pressed part. Also, a pushing part is formed on the outer side of each pushing rod, so the complete front end of the pushing block can be into a rectangular transparent trough at the center of the telephone rack. By means of the barbed structure, each of the pushing parts can push against the rectangular transparent trough. A clasping block is located on each side at the front end of the telephone rack and an extended part is extended out from the rectangular transparent trough's base plate. The extended part has a barb at the front end and an inclined block on each side. One end of the fixture is opened to cover the front end of the telephone rack. A partition board having an outlet is equipped inside the fixture. When the fixture is combined with the telephone rack, the partition board will be right next to the top of the two inclined blocks on the telephone rack and will allow the barb stretch out through the top of the outlet. When the pushing block is not pressed, the barb at the front end of the telephone rack can stretch out through the outlet of the partition board on the fixture. When the pushing block is pressed, the slope of the pressed part at the front end of the pushing block will press right on the top of the inclined blocks in the telephone rack to force the barb down. Then, the height of the barb stretching out through the outlet of the fixture will be lowered.

Preferably, by means of the combination of pivot, axle hole and latch, the back-clamping plate can be combined onto the back of the telephone rack. Also, while having the elastic connecting part, the outer wall of the back-clamping plate can be combined with the clamp-on plate to allow the user to clamp the clamp-on plate onto a belt or any other suitable object. Furthermore, a L-shaped buckle is equipped on the base of the back-clamping plate and a rectangular retaining groove is located at the respective position on the base of the fixture so that the back-clamping plate can be firmly combined onto the base of the fixture when required.

Other purposes and the structural design of the present invention will be further described in the optimal embodiments below and attached.

DETAILED DESCRIPTION OF THE PREFERRED EMBODIMENT

Figure 1:
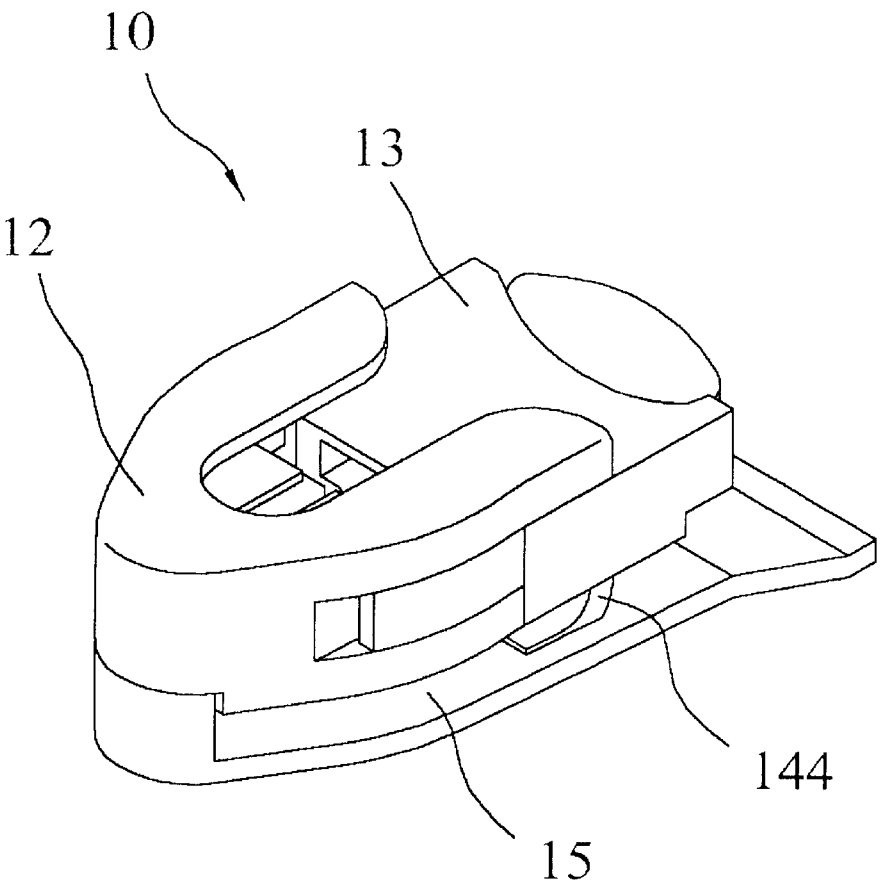
FIG. 1 is a 3-D view illustrates the embodiment of the invention.
Figure 2:
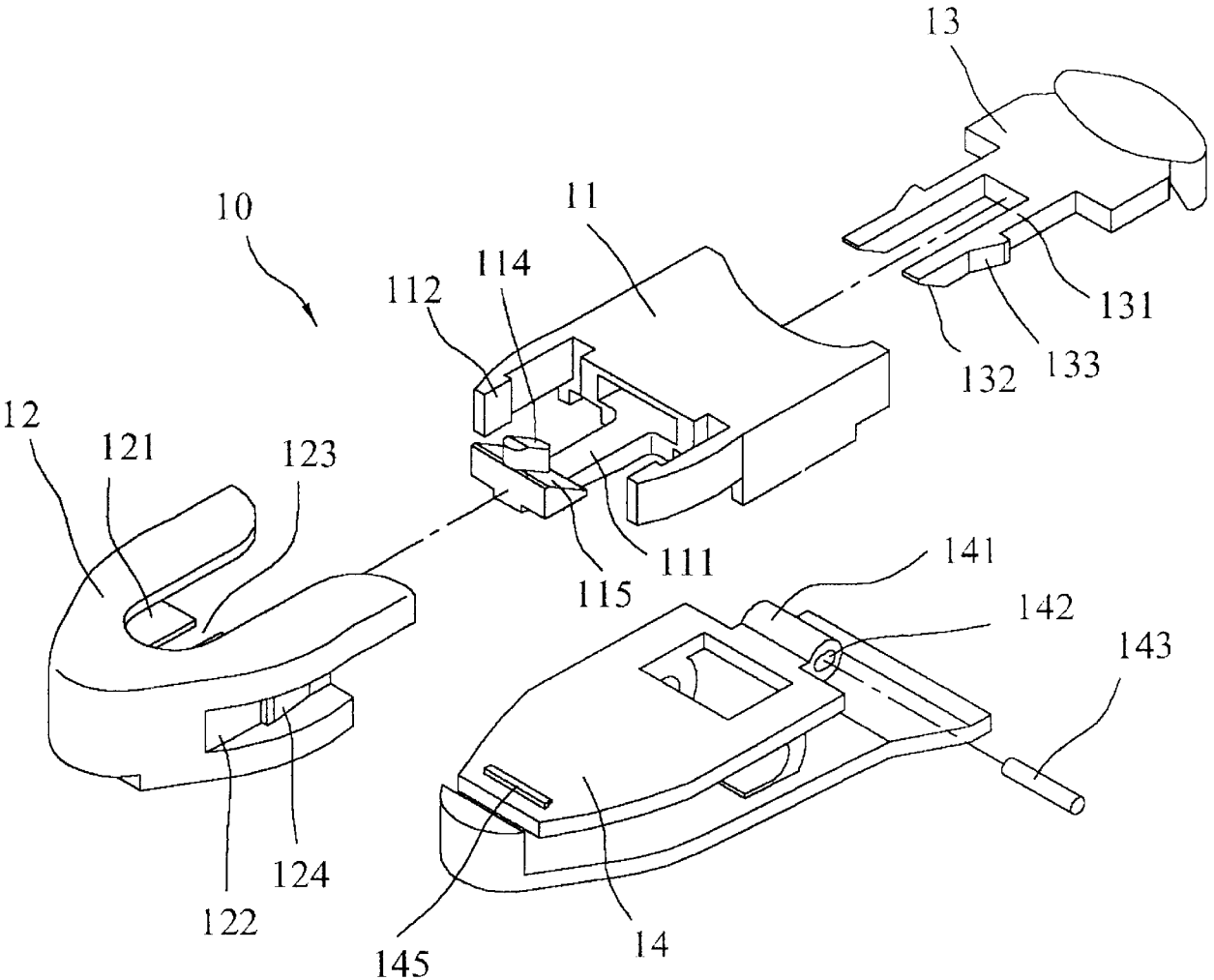
FIG. 2 is a 3-D exploded view illustrates the embodiment of the invention.

Firstly, a 3-D view and a 3-D exploded view show the embodiment of the invention in FIG. 1 and FIG. 2. The present invention comprises a telephone rack (11), a fixture (12), a pushing block (13), a back-clamping plate (14) and a clamp-on plate (15).

The rear end of the pushing block (13) is for the user to press while two pushing rods (131) extend out to form an inclined pressed part (132) in front of the pushing block (13), and a pushing part (133) on each outer side of the two pushing rods (131). The front end of the whole pushing block (13) can be inserted into a rectangular transparent trough (111) at the center of the telephone rack (11). By means of the barbed structure of the pushing parts (133), the whole pushing block (13) firmly pushes against the rectangular transparent trough (111) to avoid falling out.

A clasping block (112) is located on each side at the front end of the telephone rack (11) and an extended part (113) is extended out from the base plate of rectangular transparent trough (111). The extended part (113) has a barb (114) at the front end and an inclined block (115) on each side.

One end of the fixture (12) is opened to cover the front end of the telephone rack (11). A partition board (121) having an outlet (123) is equipped inside the fixture (12). When the fixture (12) is combined with the telephone rack (11), the partition board (121) will be right next to the top of the two inclined blocks (115) on the telephone rack (11) and will allow the barb (114) stretch out through the top of the outlet (123). A trough (122) and a clasp (124) are equipped on each outer side of the fixture (12). Each of the clasps (124) can be clipped to the respective clasping block (112) on the telephone rack (11) to combine the fixture (12) firmly onto the front end of the telephone rack (11).

Furthermore, by means of the combination of pivot (141), axle hole (142) and latch (143), and back-clamping plate (14) can be combined onto the back of the telephone rack (11). Also, while having the elastic connecting part (144), the outer wall of the back-clamping plate (14) can be combined with the clamp-on plate (15) to allow the user to clamp the clamp-on plate (15) onto a belt or any other suitable object.

Figure 3:
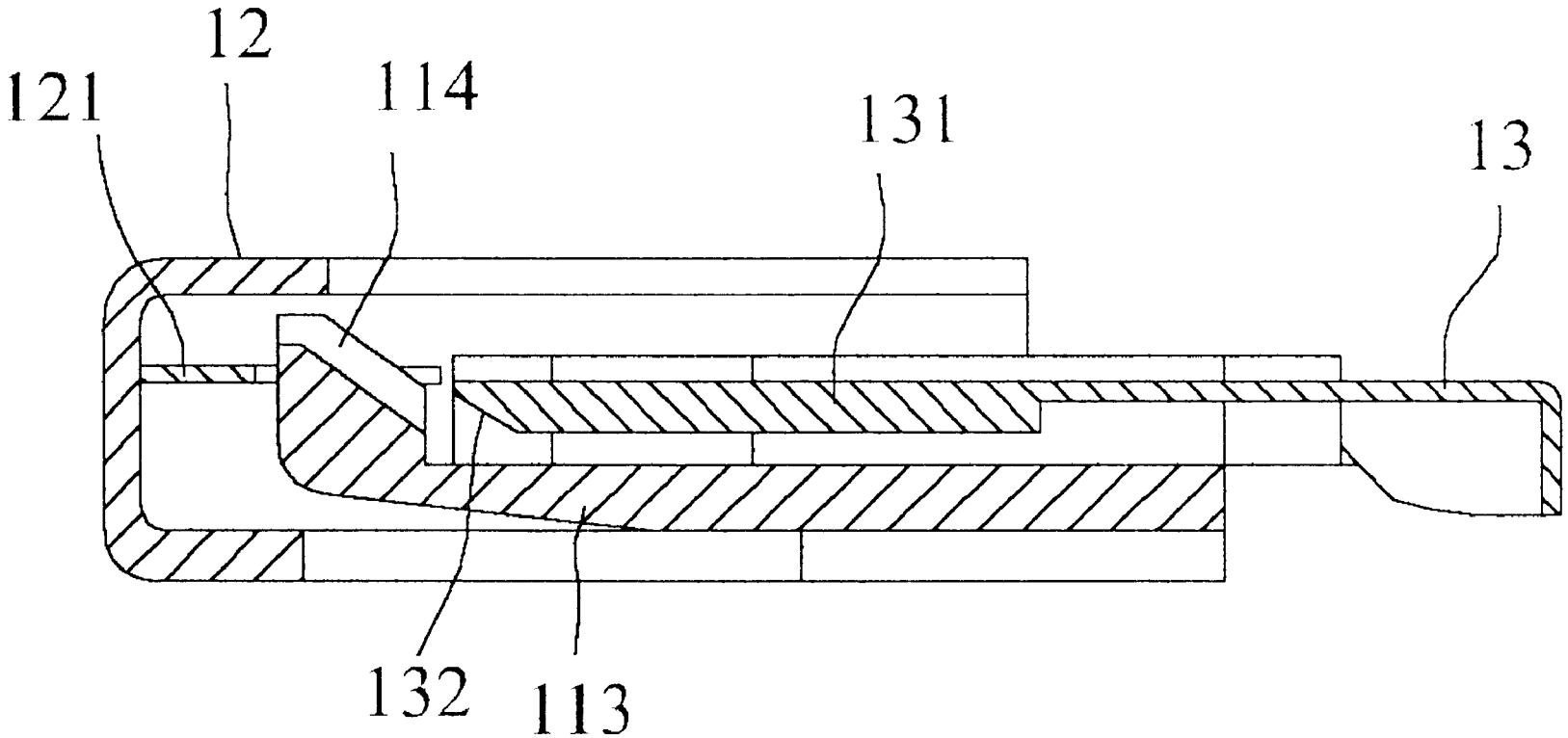
FIG. 3 is a sectional view illustrates the embodiment of the invention in clasping.
Figure 4:
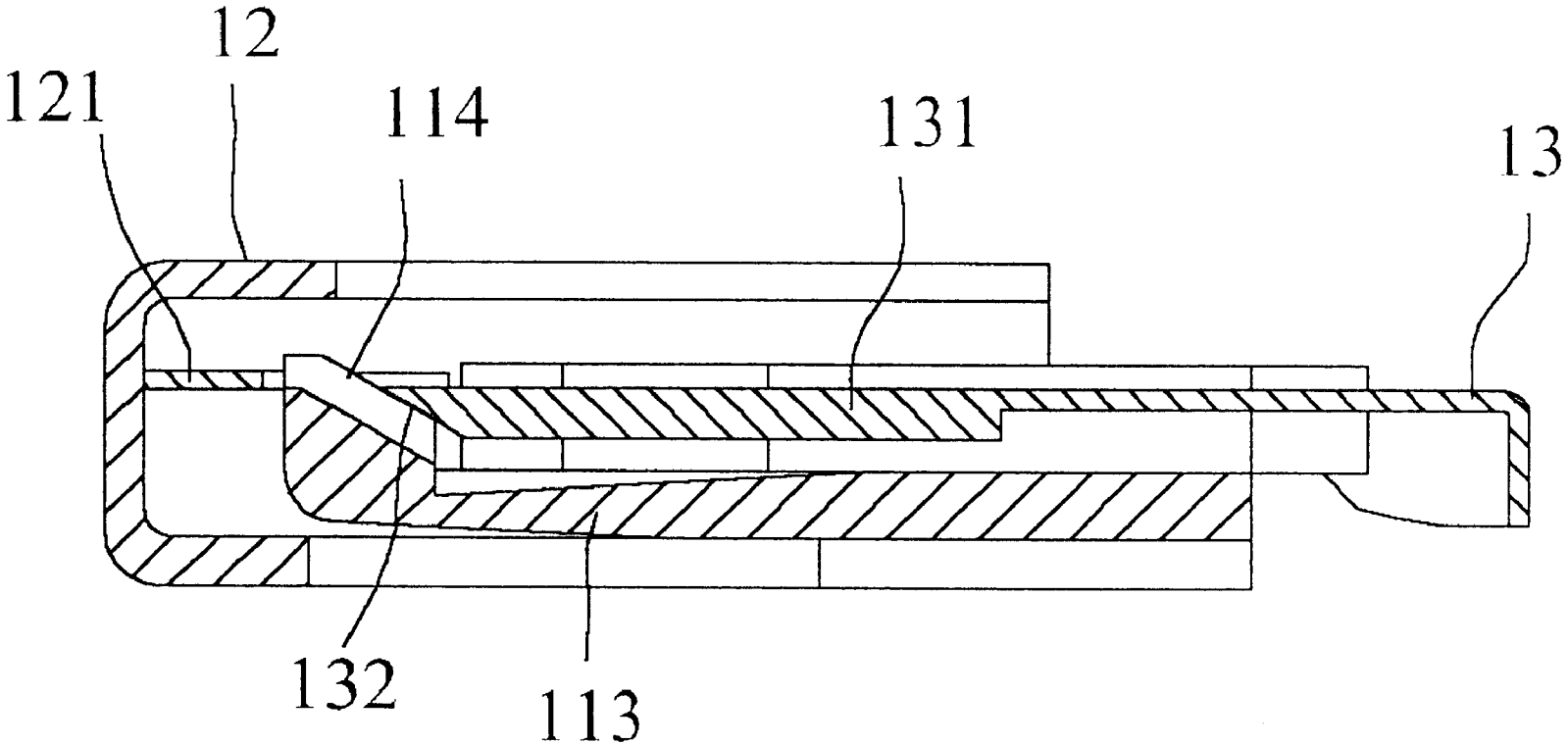
FIG. 4 is a sectional view illustrates the embodiment of the invention in releasing.

FIG. 3 and FIG. 4, sectional views, show the embodiment of the invention in clasping and in releasing, respectively. When the pushing block (13) is not pressed, the barb (114) at the front end of the telephone rack (11) can stretch out through the outlet (123) of the partition board (121) on the fixture (12) (as shown in FIG. 3). The barb (114) can then clip to a sliding ring (not shown) attached on a mobile telephone. When the pushing block (13) is pressed, the slope of the pressed part (132) at the front end of the pushing block (13) will press right on the top of the inclined blocks (115) in the telephone rack (11) to force the barb (114) down. Then, the height of the barb (114) stretching out through the outlet (123) of the fixture (12) will be lowered (as shown in FIG. 4). Then, the sliding ring attached on the back of a mobile telephone can be smoothly released out from the fixture (12).

Figure 5:
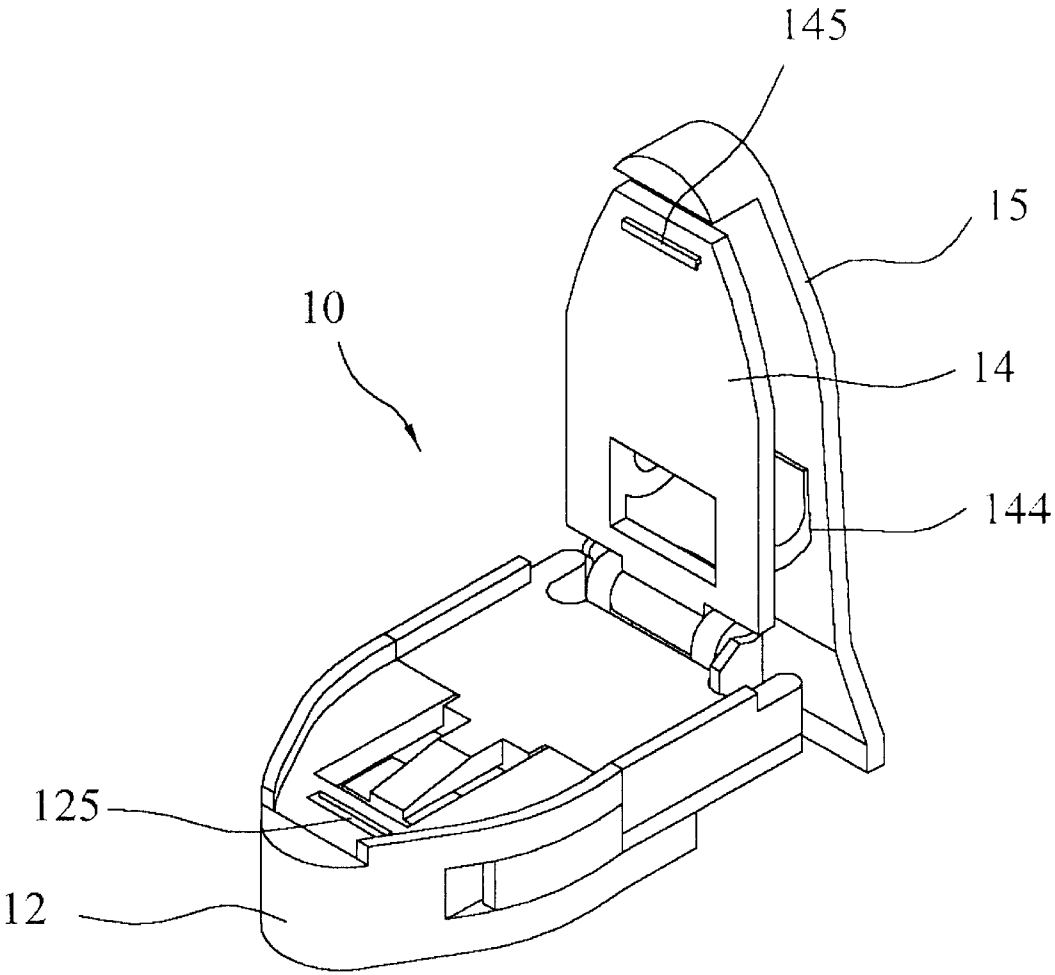
FIG. 5 is a 3-D view illustrates the embodiment of the invention when the back-clamping plate and the clamp-on plate are lifted up to a certain angle from the main unit of the back-clamping structure.
Figure 6:
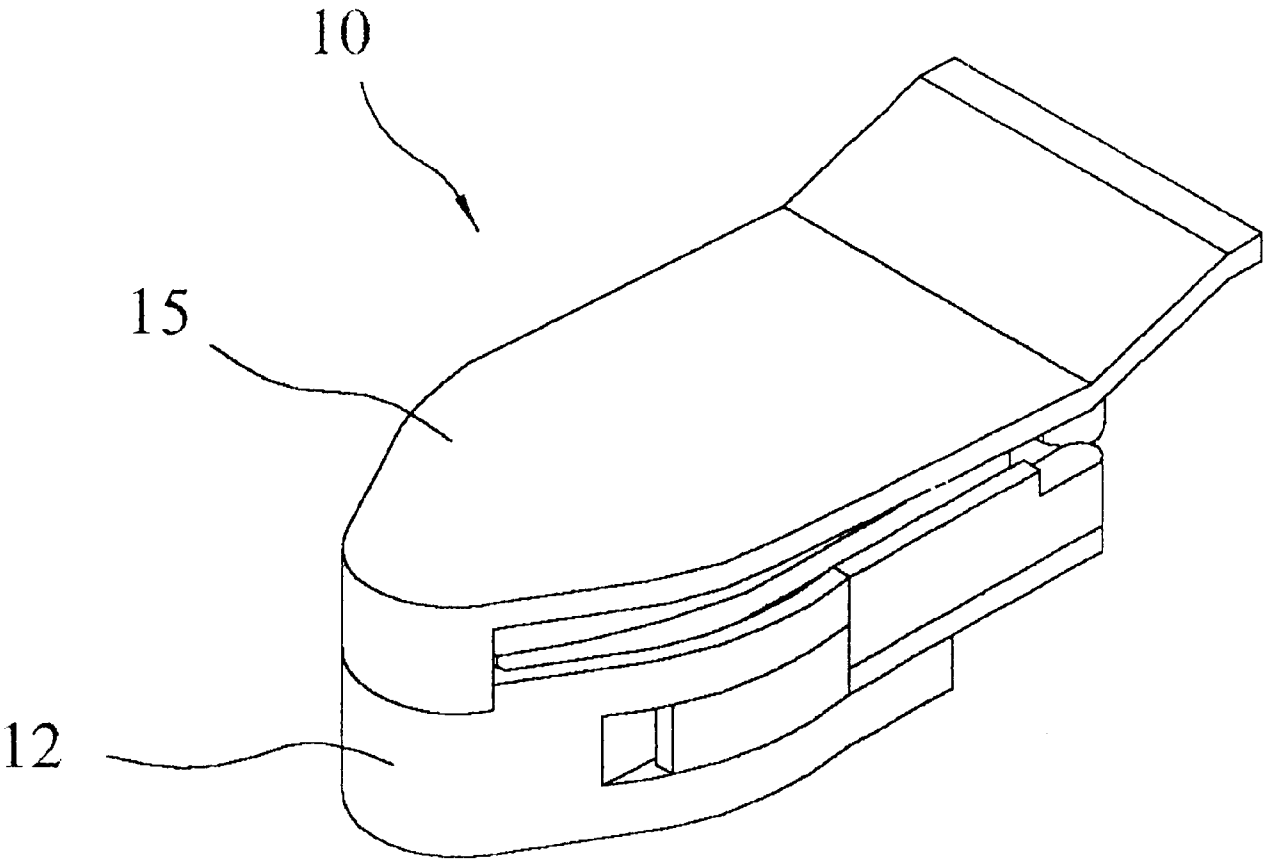
FIG. 6 is a 3-D view illustrates the embodiment of the invention when the back-clamping plate and the clamp-on plate are combined onto the main unit of the back-clamping structure.

FIG. 5 is a 3-D view illustrates the embodiment of the invention when the back-clamping plate and the clamp-on plate are lifted up to a certain angle from the main unit of the back-clamping structure. FIG. 6 is a 3-D view illustrates the embodiment of the invention when the back-clamping plate and the clamp-on plate are combined onto the main unit of the back-clamping structure. Since, with the pivot (141) as the rotation center, the back-clamping plate (14) can be lifted up to a certain angle to allow the user to view various information displayed on the screen of the mobile telephone. Also, when the back-clamping plate is not lifted up, it can be firmly combined together onto the base of the telephone rack (11). Therefore, a L-shaped buckle (145) and a rectangular retaining groove (125) are especially equipped on the base of the back-clamping plate (14) and the respective position on the base of the fixture (12), respectively. So, the L-shaped buckle (145) can be clasped to the rectangular retaining groove (125) to combine the back-clamping plate (14) onto the base of the fixture (12). The user may sometimes wish to operate on the back-clamping plate when it is lifted up to a certain angle. While having an elliptic-structured axle hole (142) on the back-clamping plate (14) (as shown in FIG. 2), all the user has to do is to gently slide the back-clamping plate (14) towards the L-shaped buckle (145) before the L-shaped buckle (145) is released from the rectangular retaining groove (125). Then, by taking the pivot (141) as the rotation center, the user can smoothly lift the back-clamping plate up to a desired angle for viewing the mobile telephone.

In summary, the improved mobile telephone back-clamping device provided by the present invention can actually perform its expected functions and maintain its industrial application value under the circumstances in easy operating and to simplify its structure. The foregoing descriptions, the invention is professional in the field can make plenty of other improvements based on the foregoing descriptions. Nevertheless, all such changes are derived from the innovation implication of the present invention and are, naturally, within the claims defined hereunder.

What is claimed is:

1. An improved mobile telephone back-clamping device, consisting of:

a telephone rack, having a rectangular trough at a center thereof, and having two clasping blocks, with each clasping block being disposed at a respective side at a front end of said telephone rack, said telephone rack further having an extended part extending out from a base plate of the rectangular trough, the extended part having a barb at a front end thereof, and an inclined block on each of its respective sides; and a fixture attachable to said telephone rack, one end of said fixture being opened to cover the front end of said telephone rack, said fixture having a partition board disposed therein, the partition board having an outlet, wherein when said fixture is attached to said telephone rack, the partition board will be disposed right next to a top of the inclined blocks, allowing the barb to project out through a top of the outlet;

a pushing block attachable only to a rear end of said telephone rack, and having two pushing rods that extend out from a front end thereof, each pushing rod having an inclined pressed part, and a pushing part having a barbed structure formed on an outer side thereof, the entire front end of said pushing block being insertable into the rectangular trough of said telephone rack, with the barbed structure of each of said pushing parts pushing against the rectangular trough;

wherein when said pushing block is not pressed, the barb at the front end of the extended part will project out through the outlet of the partition board of the fixture, and when said pushing block is pressed, a slope of the respective inclined pressed parts will press right on the top of the inclined blocks to force the barb down, thereby lowering the barb;

a back-clamping plate attached to said telephone rack; and a clamp-on plate attached to said back-clamping plate.

2. The mobile telephone back-clamping device recited in claim 1, wherein each outer side of said fixture has a clasp to clip to a respective clasping block of said telephone rack, so that said fixture is firmly attached to the front end of said telephone rack.

3. The mobile telephone back-clamping device recited in claim 1, further comprising a pivot, axle hole and latch that attach said back-clamping plate onto a back of said telephone rack; and an elastic connecting part connecting an outer wall of said back-clamping plate to said clamp-on plate, to allow a user to clamp the clamp-on plate onto an object.

4. The mobile telephone back-clamping device recited in claim 3, wherein a base of said back-clamping plate includes an L-shaped buckle, and a base of said fixture includes a rectangular retaining groove, the L-shaped buckle being clasped to the rectangular retaining groove, so that said back-clamping plate is firmly combined to the base of said fixture.

5. The mobile telephone back-clamping device recited in claim 3, wherein the axle hole is formed on the back-clamping plate, and is an elliptic axle hole.

* * * * *